US008099909B2

(12) United States Patent
Bottriell

(10) Patent No.: US 8,099,909 B2
(45) Date of Patent: Jan. 24, 2012

(54) EAVESTROUGH PROTECTOR

(76) Inventor: Phil Bottriell, Kanata (CA)

( * ) Notice: Subject to any disclaimer, the term of this patent is extended or adjusted under 35 U.S.C. 154(b) by 55 days.

(21) Appl. No.: 12/701,511

(22) Filed: Feb. 5, 2010

(65) Prior Publication Data

US 2011/0192094 A1 Aug. 11, 2011

(51) Int. Cl.

| | |
|---|---|
| ***E04D 13/076*** | (2006.01) |
| ***E04D 13/00*** | (2006.01) |
| *E03F 5/14* | (2006.01) |
| *B01D 24/10* | (2006.01) |

(52) U.S. Cl. ..... 52/12; 52/745.2; 210/162; 210/474

(58) Field of Classification Search ..... 52/12; 210/162, 210/163, 167.2, 474

See application file for complete search history.

(56) References Cited

U.S. PATENT DOCUMENTS

| | | | | | |
|---|---|---|---|---|---|
| 2,533,402 | A * | 12/1950 | Schmitz, Jr. | 210/463 |
| 3,739,913 | A * | 6/1973 | Bogosian | 210/242.4 |
| 4,366,067 | A * | 12/1982 | Golding et al. | 210/671 |
| 5,107,635 | A * | 4/1992 | Carpenter | 52/12 |
| 5,242,591 | A * | 9/1993 | Beechert et al. | 210/474 |
| 5,374,133 | A * | 12/1994 | Lazes et al. | 405/68 |
| 5,632,888 | A * | 5/1997 | Chinn et al. | 210/163 |
| 5,679,247 | A * | 10/1997 | Burke | 210/242.4 |
| 5,688,075 | A * | 11/1997 | Gradek | 405/63 |
| 6,083,402 | A * | 7/2000 | Butler | 210/663 |
| 6,551,505 | B2 * | 4/2003 | Chinn et al. | 210/164 |
| 6,869,525 | B1 * | 3/2005 | Happel | 210/163 |
| 7,051,480 | B1 * | 5/2006 | Dennis | 52/24 |
| 7,300,574 | B1 * | 11/2007 | Lewis | 210/163 |
| 2003/0110713 | A1 * | 6/2003 | Fauster | 52/24 |
| 2004/0006927 | A1 * | 1/2004 | Wickett | 52/12 |
| 2005/0034376 | A1 * | 2/2005 | Pourdeyhimi et al. | 52/11 |
| 2009/0101591 | A1 * | 4/2009 | Lewis | 210/747 |
| 2009/0277820 | A1 * | 11/2009 | Sunkins | 210/163 |

OTHER PUBLICATIONS

Website http://www.leafdefier.com/leafdefier/, 1 page, dated Mar. 23, 2010.

* cited by examiner

*Primary Examiner* — Robert Canfield

(74) *Attorney, Agent, or Firm* — James P. Muraff; Neal, Gerber & Eisenberg LLP

(57) ABSTRACT

An eavestrough protector or filter comprises an elongated and conformable container dimensioned to fit at least partially within an eavestrough. The container is water-permeable to permit water to flow through said container. A low-density fill material, e.g. an expanded polymer, is disposed within the container. The fill material has a density less than that of water to thereby float the protector when the container is filled with said fill material, thus providing a conformable floating eavestrough protector that is permeable to water. The protector may be inserted into an eavestrough or gutter to shield the eavestrough or gutter from becoming clogged with leaves, twigs or other debris. The foam protector is permeable to rainwater and floats on the water flowing through the eavestrough.

9 Claims, 2 Drawing Sheets

EAVESTROUGH PROTECTOR

CROSS-REFERENCE TO RELATED APPLICATIONS

This is the first application filed for the present invention.

TECHNICAL FIELD

The present invention relates generally to eavestroughs and, in particular, to devices for shielding or protecting eavestroughs from leaves, twigs and other debris.

BACKGROUND

An eavestrough or rain gutter is a channel or trough that collects rainwater flowing down from the roof and delivers the rainwater through a downspout and then away from the foundation. The eavestroughs on a dwelling are prone to becoming clogged with leaves, twigs, and other debris especially where there are tall trees in the immediate vicinity. These eavestroughs must be periodically cleaned which is inconvenient.

One prior-art solution is to attach a metal shield over the eavestrough that nonetheless permits the ingress of water from the roof. While this technique works, it is costly and time-consuming to install.

Accordingly, there remains a need for a simple, cost-effective solution to the problem of clogged eavestroughs. This has remained a technical problem for which an adequate solution has, until now, yet to be devised.

SUMMARY

The present invention provides a novel eavestrough protector designed to keep leaves, twigs and other debris from falling into and clogging the eavestrough. The eavestrough protector is made of a container that contains low-density pieces of fill material which may be, for example, pieces of expanded polymer foam. This elongated, conformable container may be made of a mesh or other water-permeable material so that rainwater shed from the roof passes through the protector into the eavestrough while filtering out leaves, bits of leaves, twigs, insects, airborne debris, etc. This protector thus acts as an eavestrough filter. When filled with the pieces of expanded polymer foam, the protector (filter) has a density less than water. Accordingly, when rainwater flows in the eavestrough, the protector/filter floats atop the water, thereby ensuring that the eavestrough retains its flow capacity.

In accordance with one main aspect of the present invention, an eavestrough protector comprises an elongated and conformable container dimensioned to fit at least partially within an eavestrough, the container being water-permeable to permit water to flow through said container. The eavestrough protector also includes a low-density fill material disposed within said container, said fill material having a density less than that of water to thereby float the protector when the container is filled with said fill material, thus providing a conformable floating eavestrough protector that is permeable to water.

In accordance with another main aspect of the present invention, a method of shielding an eavestrough from leaves, twigs and other debris entails providing an elongated and conformable container dimensioned to fit at least partially within an eavestrough, the container being water-permeable to permit water to flow through said container. The method further entails filling the container with a low-density fill material having a density less than that of water to thereby float the protector when the container is filled with said fill material. The method further entails inserting the container containing the fill material at least partially within the eavestrough to thus provide a conformable floating eavestrough protector that is permeable to water.

BRIEF DESCRIPTION OF THE DRAWINGS

Further features and advantages of the present technology will become apparent from the following detailed description, taken in combination with the appended drawings, in which.

DETAILED DESCRIPTION

In general, and by way of overview, the present invention is an eavestrough protector, or "eavestrough filter", designed to protect and shield the eavestrough from leaves, twigs and other debris that can clog the eavestrough. The eavestrough protector has an elongated, conformable water-permeable container that contains foam pieces, e.g. pieces of lightweight expanded polymer foam. Rainwater shed from the roof can thus filter through the eavestrough protector into the eavestrough. Leaves, bits of leaves, twigs, dead insects or other debris is blocked from entering the eavestrough. Since the container contains pieces of lightweight expanded polymer foam, the container is very light. This facilitates installation, avoids placing unwanted weight on the eavestrough and roof, and has the added benefit that the protector floats on water. Accordingly, the eavestrough protector does not obstruct or hinder the flow of rainwater in the eavestrough as it rises and falls with the water level in the eavestrough.

Figure 1:
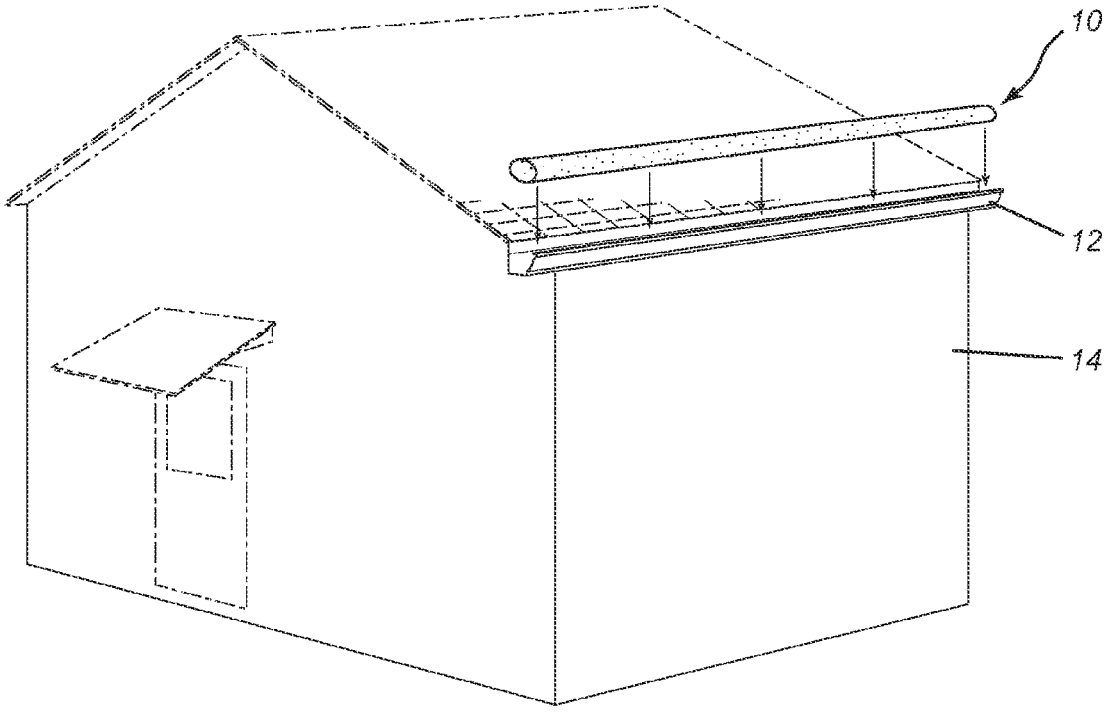
FIG. 1 is a perspective view of an eavestrough protector (gutter protector) in accordance with one embodiment of the present invention.

FIG. 1 depicts an eavestrough protector in accordance with one embodiment of the present invention. The eavestrough protector (which is also referred to herein as an eavestrough filter or gutter protector) is generally denoted by reference numeral 10. This eavestrough protector or gutter protector is designed to be installed into an eavestrough 12 (or gutter) affixed along a roof of a dwelling 14. As shown in the embodiment depicted in FIG. 1, the eavestrough protector comprises a flexible, conformable, substantially tubular container. This container and its fill material are permeable to rainwater but nonetheless block leaves, twigs or other debris from falling into and clogging the eavestrough.

Figure 2:
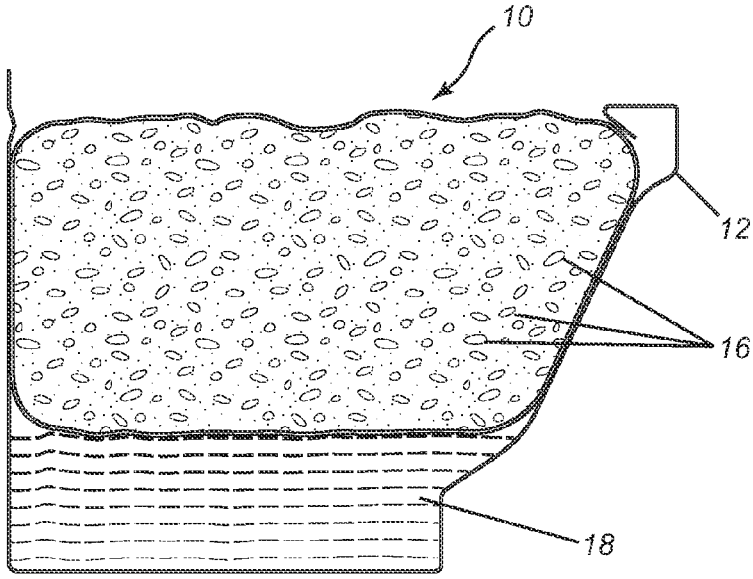
FIG. 2 is a cross-sectional view of the eavestrough protector installed inside an eavestrough.

FIG. 2 is a cross-sectional view of the eavestrough protector (gutter protector) 10 installed at least partially within an eavestrough or gutter 12. The protector/filter 10 comprises a container (elongated enclosure or bag) which is made from a flexible water-permeable material such as a mesh, fabric, woven material or porous membrane. The container contains a lightweight (low-density) fill material. For example, inside the container (e.g. mesh) could be a plurality of pieces 16 of foam, e.g. expanded polymer foam or equivalent. Therefore, in one specific embodiment, this foam-filled mesh container contains a plurality of lightweight foam pieces that are loosely packed inside the container so as to allow water to filter through the protector while also imbuing the protector with a suitable level of conformability.

As shown in FIG. 2, the foam-filled gutter protector is not only permeable to rainwater but also floatable on top of the water 18 flowing in the eavestrough. In other words, because of its low-density filling, the protector floats on the surface of the water. When the level of water in the eavestrough rises, so does the protector. Accordingly, the protector/protector does not obstruct or hinder the flow of water in the eavestrough. As a further benefit, the soft conformable foam-filled container is very lightweight, thus imposing a very minimal weight on the eavestrough and roof. Its light weight also makes the product easy to carry and lift up for installation into the eavestroughs. The product is simply tucked into the eavestrough. No fasteners or adhesives are required for installation of this product. The product can thus be removed easily as well. The product can be made to any suitable length or sold in segments that can be used end to end or around bends (due to its high level of conformability).

Figure 3:
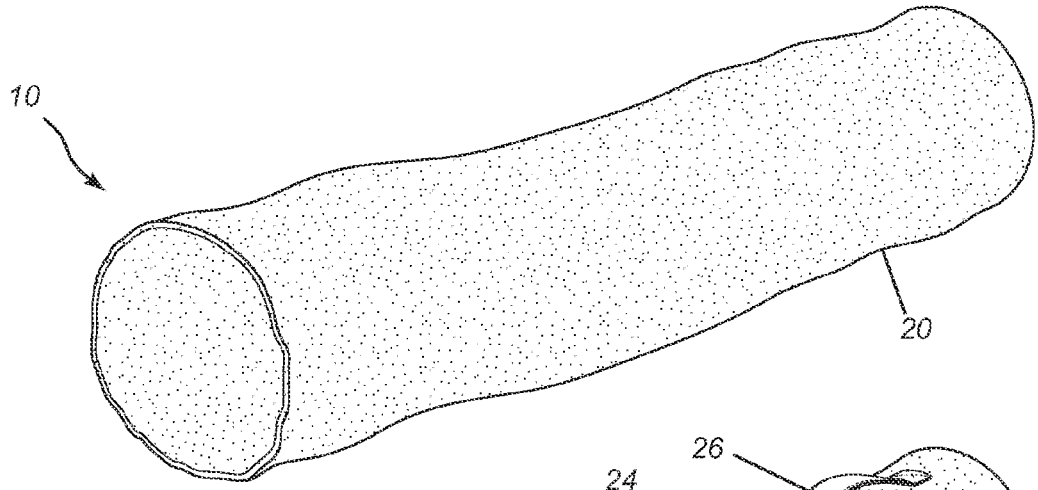
FIG. 3 is a perspective view of the protector/filter in accordance with one embodiment of the present invention.

FIG. 3 is a perspective view of the protector/filter 10 in accordance with one embodiment of the present invention. As shown in the particular embodiment depicted in this figure, the container may be a tubular mesh container 20 although other shapes may be used. A suitable flexible material for the container of the protector may be selected from non-biodegradable materials which may or may not include UV stabilization compounds in order to prevent UV degradation. Suitable polymer materials for the foam-based fill material include polyethylene, polypropylene, polystyrene, polyvinyl chloride, and polyester. The non-biodegradable materials may be comprised of recycled plastics as well as virgin plastic and additionally may incorporate other suitable materials made from paper as well as polymeric materials or other suitable recycled composite materials.

In order to facilitate water passage, the container is preferably composed of mesh or otherwise perforated to mimic the concept of having a mesh structure. Depending on the intended use of the container, the mesh size may vary substantially from 0.1 mm to 10 mm.

Figure 4:
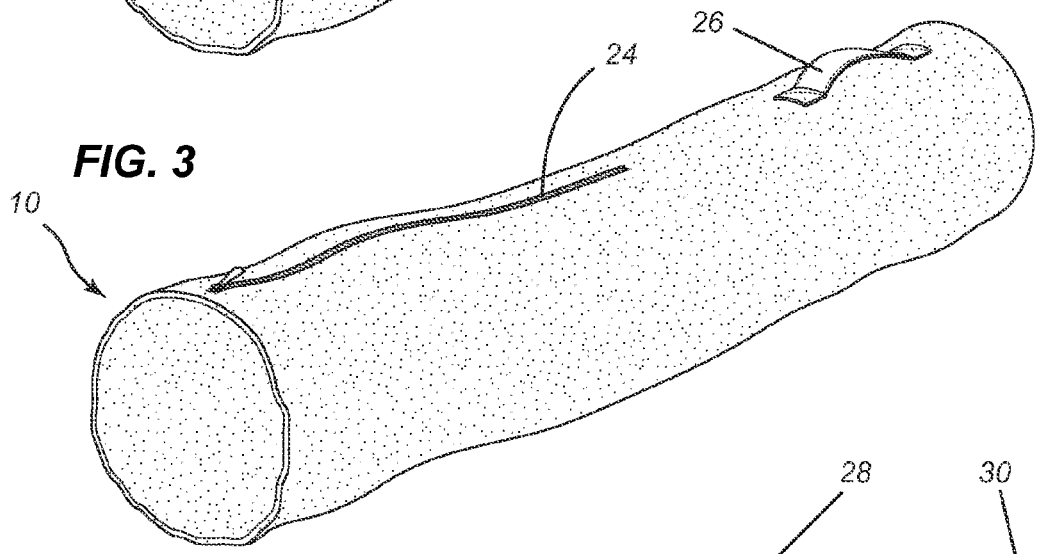
FIG. 4 is a perspective view of another embodiment of the protector/filter with an opening means.

As illustrated in the embodiment depicted in FIG. 4, the container 20 may optionally have a zipper opening 24 (or other opening means such as, for example, a Ziploc® closure, buttons, snaps, laces, hooks, etc. A handle 26 may optionally be provided to facilitate handling. Although these examples have been shown in FIG. 4, it will be evident that the container 20 may be sealed permanently (e.g. heat sealed, taped, bonded or otherwise fixed secured to provide a permanent seal to lock in the foam pieces or other fill material).

Figure 5:
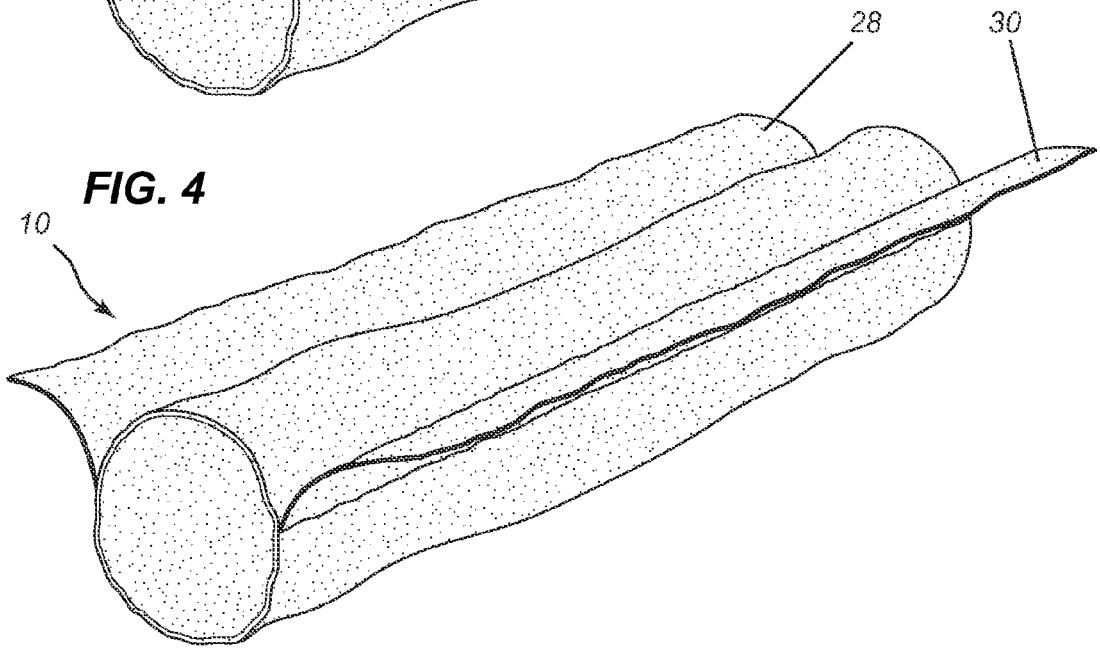
FIG. 5 is a perspective view of another embodiment of the eavestrough protector/filter having first and second flaps.

FIG. 5 shows another embodiment of the present invention in which the container 20 includes a first flap 28 and a second flap 30. Alternatively, a variant of the container could have only one flap, either only the first flap or only the second flap. The first flap may be used for draping over an outward face of the eavestrough and the second flap may be used for engaging a roof on which the eavestrough is mounted. These flaps ensure that debris does not lodge between the protector and the eavestrough or roof.

The eavestrough protector need not be completely inserted inside the eavestrough or flush with its top edges. Rather, the eavestrough protector can be installed such that it is at least partially inserted into the eavestrough. The eavestrough protector will rise and fall with the water level. Therefore, a loose fit inside the eavestrough allows the eavestrough protector to move up and down with the water level in the gutter.

The embodiments of the invention described above are intended to be exemplary only. As will be appreciated by those of ordinary skill in the art, to whom this specification is addressed, many obvious variations can be made to the embodiments present herein without departing from the spirit and scope of the invention. The scope of the exclusive right sought by the applicant is therefore intended to be limited solely by the appended claims.

What is claimed is:

1. An eavestrough protector comprising:

an elongated and conformable container dimensioned to fit at least partially within an eavestrough, the container being water-permeable to permit water to flow through said container, said container comprising a first flap for draping over an outward face of the eavestrough and a second flap for engaging a roof on which the eavestrough is mounted; and a low-density fill material disposed within said container, said fill material having a density less than that of water to thereby float the protector when the container is filled with said fill material, thus providing a conformable floating eavestrough protector that is permeable to water.

2. The eavestrough protector as claimed in claim 1 wherein said low-density fill material is non-biodegradable.

3. The eavestrough protector as claimed in claim 1 wherein said low-density fill material comprises a plurality of pieces made of an expanded polymer foam.

4. The eavestrough protector as claimed in claim 3 wherein said expanded polymer foam is selected from a group consisting of polyethylene, polypropylene, polystyrene, polyvinyl chloride, and polyester.

5. The eavestrough protector as claimed in claim 1 wherein said container is a tubular mesh.

6. The eavestrough protector as claimed in claim 5 wherein said tubular mesh has a mesh opening of between 0.1 mm and 10 mm.

7. A method of shielding an eavestrough from leaves, twigs and other debris, the method comprising:

providing an elongated and conformable container dimensioned to fit at least partially within an eavestrough, the container being water-permeable to permit water to flow through said container;

filling the container with a low-density fill material having a density less than that of water to thereby float the protector when the container is filled with said fill material;

inserting the container containing the fill material at least partially within the eavestrough to thus provide a conformable floating eavestrough protector that is permeable to water; and draping a first flap extending from the container over an outward face of the eavestrough.

8. The method as claimed in claim 7 wherein filling the container with the fill material comprises filling the container with foam pieces made of an expanded polymer foam.

9. The method as claimed in claim 7 further comprising connecting a second flap to a roof on which the eavestrough is mounted.

* * * * *